US008128268B2

(12) United States Patent
Umeda et al.

(10) Patent No.: US 8,128,268 B2
(45) Date of Patent: Mar. 6, 2012

(54) LIGHT-EMITTING DEVICE, AND LENS USED IN THE SAME

(75) Inventors: Yukihiko Umeda, Aichi-ken (JP); Kazushi Noda, Aichi-ken (JP)

(73) Assignee: Toyoda Gosei Co., Ltd., Aichi-ken (JP)

( * ) Notice: Subject to any disclaimer, the term of this patent is extended or adjusted under 35 U.S.C. 154(b) by 323 days.

(21) Appl. No.: 12/382,541

(22) Filed: Mar. 18, 2009

(65) Prior Publication Data

US 2009/0244898 A1 Oct. 1, 2009

(30) Foreign Application Priority Data

Mar. 28, 2008 (JP) ..... P.2008-087600

(51) Int. Cl.
*F21V 8/00* (2006.01)

(52) U.S. Cl. ..... 362/555; 362/558; 362/311.09; 362/311.1

(58) Field of Classification Search ..... 362/555, 362/551, 558, 511, 311.09, 311.1, 340
See application file for complete search history.

(56) References Cited

U.S. PATENT DOCUMENTS

| | | | | |
|---|---|---|---|---|
| 6,786,628 | B2 * | 9/2004 | Steen et al. | 362/572 |
| 7,837,348 | B2 * | 11/2010 | Narendran et al. | 362/231 |
| 2007/0189010 | A1 * | 8/2007 | Arai | 362/257 |

FOREIGN PATENT DOCUMENTS

| | | |
|---|---|---|
| GB | 2 248 493 A | 4/1992 |
| JP | 4-233102 (A) | 8/1992 |
| JP | 2005-029030 | 2/2005 |
| JP | 2005-300321 (A) | 10/2005 |
| JP | 2006-013087 | 1/2006 |

OTHER PUBLICATIONS

Japanese Office Action dated Jul. 21, 2011 (with an English translation).

* cited by examiner

*Primary Examiner* — Sharon Payne
(74) *Attorney, Agent, or Firm* — McGinn IP Law Group, PLLC

(57) ABSTRACT

A light-emitting element 1 has a rod-shaped light-emitting element 3, an LED lamp 10, and a lens 20 for converging light from the LED lamp to an end face of the rod-shaped light-emitting element. The lens 20 has a scattering area around the centerline of an extremity thereof, and the scattering area scatters light in proximity to the centerline, thereby irradiating an inner peripheral surface of the rod-shaped light-emitting element 3 with the light.

18 Claims, 5 Drawing Sheets

LIGHT-EMITTING DEVICE, AND LENS USED IN THE SAME

BACKGROUND OF THE INVENTION

1. Field of the Invention

The present invention relates to a light-emitting device as well as to a lens used in the light-emitting device.

2. Description of the Related Art

In order to cause a side surface of a rod-shaped element formed from a transparent resin, and the like, to illuminate, a light-emitting device configured so as to introduce light from an LED lamp serving as an LED light source to an end face of the rod-shaped light-emitting element has already been put forward (Patent Document 1 and Patent Document 2).

Since the end face of the rod-shaped light-emitting element has a small area, light from an LED chip must be converged to the end face in order to sufficiently introduce light into the rod-shaped light-emitting element. For this reason, in Patent Document 1, an LED lamp is placed in a case-shaped joined element, and light from the LED lamp is converged to an end face of the rod-shaped light-emitting element by utilization of a reflection surface of the interior surface of the joined element.

Patent Document 1: JP-A-2005-29030

Patent Document 2: JP-A-2006-13087

An invention described in Patent Document 1 is on the premise that a plurality of LED lamps are arranged with respect to an end face of a rod-shaped light-emitting element (see FIG. 4 of Patent Document 1, and the like). The reason for this is that a sufficient quantity of light is ensured and that the light is supplied to a peripheral surface of the rod-shaped light-emitting element, thereby reliably illuminating the peripheral surface.

From the viewpoint of a reduction in the number of components, realizing an LED lamp as a single component has been requested. The present inventors have conducted a study to meet such a request and found the following problem.

Specifically, in a single LED lamp, the centerline of the LED lamp is aligned to the centerline of the rod-shaped light-emitting element in order to uniformly supply light to the end face of the rod-shaped light-emitting element. In order to converge light from the LED lamp and reliably irradiate the end face of the rod-shaped light-emitting element with the light, a lens must be interposed between the LED lamp and the rod-shaped light-emitting element.

When a common condensing lens is used, light from the LED lamp can be reliably converged to an end face of the rod-shaped light-emitting element. However, light in proximity to the centerline of the LED lamp becomes substantially parallel to the centerline. Accordingly, light still remains substantially parallel to the centerline even in a rod-shaped light-emitting element and hardly goes out of a side surface (a light-emitting face) of the rod-shaped light-emitting element.

SUMMARY OF THE INVENTION

The present invention has been conceived to solve the problem and defined as follows:

A light-emitting device having a rod-shaped light-emitting element, an LED light source, and a lens for converging light from the LED light source to an end face of the rod-shaped light-emitting element, wherein the lens has a scattering area around a centerline of an extremity of the lens, and a scattering area scatters light in proximity to the centerline, to thus irradiate an inner peripheral surface of the rod-shaped light-emitting element with the light.

In the first curved surface of the thus-defined invention, the scattering area forcefully refracts light around the centerline of the lens, whereupon the light is radiated so as to become distant from the centerline. As a consequence, the light is also radiated onto the internal peripheral surface of the rod-shaped light-emitting element while deviating from the center of the rod-shaped light-emitting element. Thus, the light undergoes multiple refraction within the rod-shaped light-emitting element, so that brightness of a circumferential wall of the rod-shaped light-emitting element is increased.

In a second phase of the present invention, the geometry of the scattering area is defined as follows. Specifically, the scattering area has a curved surface formed such that the light passed through a refraction plane of the scattering area, to thus be refracted toward the centerline, and that the light passes through a point in the centerline that becomes further distant from the extremity of the lens according as a point on the refraction plane passed by the light becomes further distant from the centerline in a radial direction.

In the thus-defined second phase of the invention, the light close to the centerline is greatly refracted, to thus pass through a point in the centerline (an extension) located immediately before the lens. The thus-refracted light is radiated on an inner peripheral surface close to the end face of the rod-shaped light-emitting element; hence, the light greatly contributes to illumination of the peripheral surface of the rod-shaped light-emitting element.

Providing only the extremity of the lens with a curved surface differing from that imparted to the other area of the lens during manufacture of the lens imposes a heavy burden on manufacturing processes. Therefore, it is desirable to produce the entirety of the lens as defined by third to fifth aspects of the invention. Specifically, the lens is formed such that the light passed through a refraction plane of the lens, to thus be refracted toward a centerline, and that the light passes through a point in the centerline that becomes further distant from the extremity of the lens according as a point on the refraction plane passed by the light becomes further distant from the centerline in a radial direction.

A convex area or a concave area can also be provided in the extremity of the lens in order to scatter light in proximity to the centerline of the lens. The light passed through the convex area or the concave area undergoes refraction on the refraction plane of the lens, so as not to indiscriminately travel in substantially parallel to the centerline. Consequently, the light reaches a point on the internal peripheral surface close to the end face of the rod-shaped light-emitting element and iteratively undergoes reflection within the rod-shaped light-emitting element, thereby illuminating the circumferential wall of the rod-shaped light-emitting element more brightly.

DESCRIPTION OF THE PREFERRED EMBODIMENTS

An embodiment of the present invention will be described hereunder.

Figure 1:
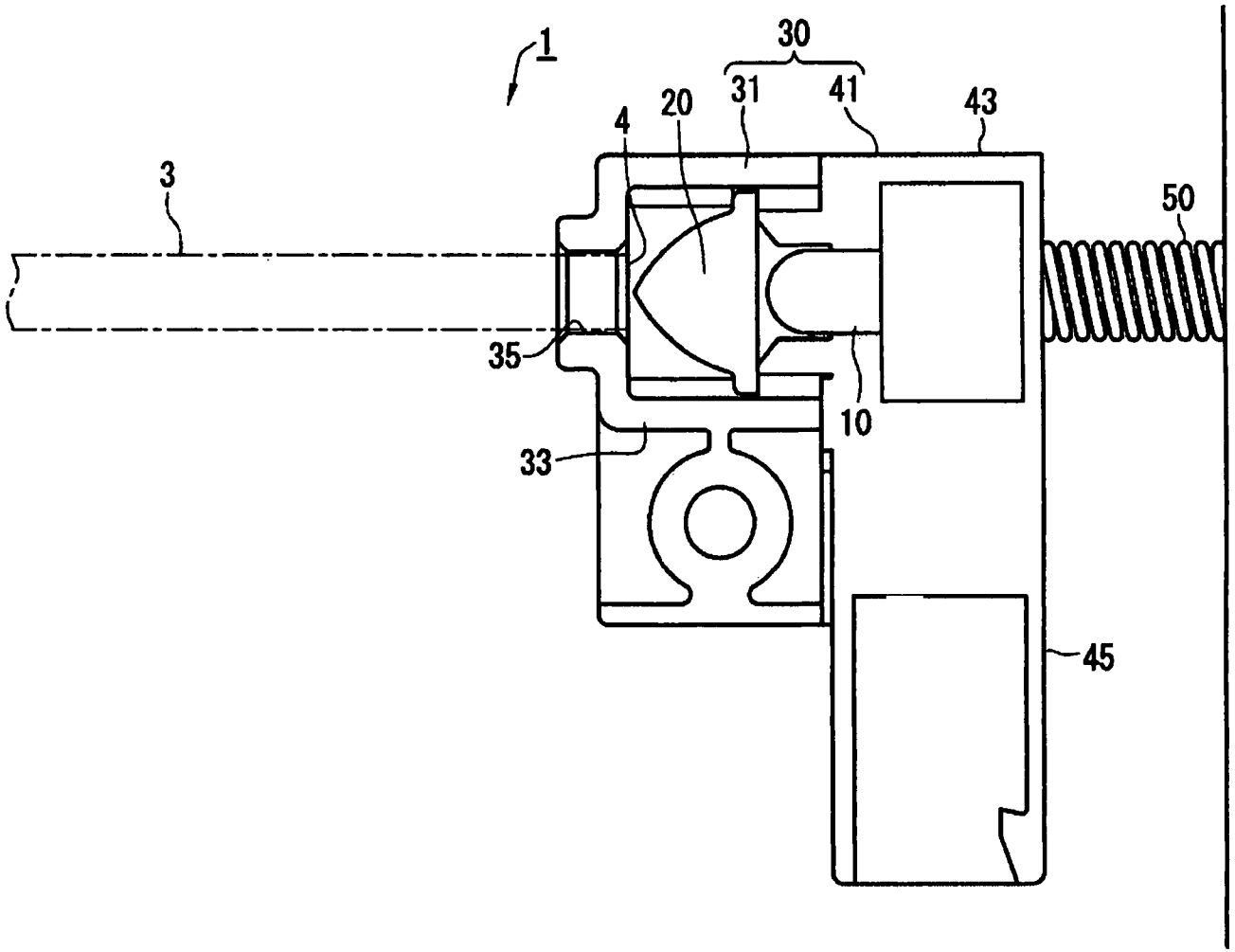
FIG. 1 is a cross-sectional view showing the configuration of a light-emitting device 1 of an embodiment of the present invention.

FIG. 1 shows a light-emitting device 1 of the present embodiment. The light-emitting device 1 has a rod-shaped light-emitting element 3, an LED lamp 10, a lens 20, and a casing 30.

The rod-shaped light-emitting element 3 is made from an optically transparent resin material (acryl, and the like). The length and diameter of the rod-shaped light-emitting element 3 are arbitrarily selected according to an application. It is preferable that a scattering agent be dispersed such that light is uniformly emitted from the side surface of the rod-shaped light-emitting element 3. Moreover, in order to cause a leading-end side (an end apart from a light inlet surface) to sufficiently illuminate, light must be reflected within the rod-shaped light-emitting element. Accordingly, it is preferable that the rod-shaped light-emitting element 3 be provided with a two-layer structure consisting of a core for guiding light and a clad for scattering and emitting light.

The LED lamp 10 is used as the light source. The LED lamp has various advantages, such as compactness, low drive power, a low heating value, and long life. No specific limitations are imposed on the type of an LED lamp, and various types of LED lamps, such as a shell-type (lens-type) LED lamp, a surface-mount (SMD)-type LED lamp, and a chip-on-board (COB)-type LED lamp, can be used.

In the present embodiment, the number of LED lamp used is one, and the centerline of the LED lamp is aligned to the centerline of the rod-shaped light-emitting element 3. A plurality of LED chips can be accommodated in the LED lamp. The color and output of the LED lamp can be arbitrarily selected according to the use and objective of the rod-shaped light-emitting element 3.

The lens 20 is interposed between the rod-shaped light-emitting element 3 and the LED lamp 10, and collects light from the LED lamp 10 and guides the thus-collected light to an end face of the rod-shaped light-emitting element 3. The centerline of the lens 20 coincides with the centerline of the rod-shaped light-emitting element 3 (the center of the end face 4) and the centerline of the LED lamp 10. The structure of the lens 20 will be described in detail later.

Figure 2:
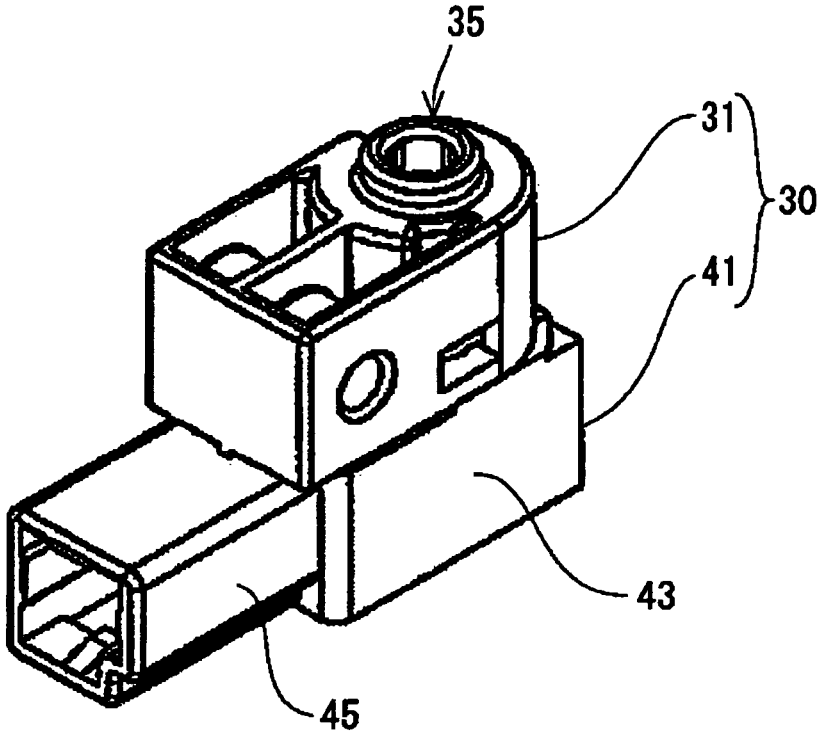
FIG. 2 is a perspective view showing a casing 30.

As can be seen in a perspective view shown in FIG. 2, the casing 30 has a lens support 31 and a lamp support 41. The lens support 31 has a cylindrical portion 33, and the lens 20 is accommodated in the cylindrical portion 33. A through hole 35 is opened in an upper surface of the cylindrical portion 33, and an end of the rod-shaped light-emitting element 3 is inserted into the through hole 35. From the viewpoint of prevention of leakage of light and assurance of mechanical stability, it is preferable that the rod-shaped light-emitting element 3 be forcefully fitted to a circumferential wall of the through hole 35 of the lens support 31.

Since the rod-shaped light-emitting element 3 formed from resin greatly expands and contracts in its axial direction in accordance with changes in ambient temperature. Therefore, in order to prevent exertion of unnecessary stress between the casing 30 and the lens support 31, it is desirable to impel the casing 30 in the axial direction of the rod-shaped light-emitting element 3 by means of a compression coil spring 50, to thus cause the casing to follow contraction and expansion of the rod-shaped light-emitting element 3. Accordingly, it is preferable to align the centerline of the compression coil spring 50 to an extension of the centerline of the rod-shaped light-emitting element 3.

The lens support 31 is made movable with respect to the lamp support 41 along the direction of the centerline of the rod-shaped light-emitting element 3, and a compression coil spring may also be interposed between the lamp support 41 and the lens support 31.

The lamp support 41 has a portion 43 for holding the LED lamp 10 and a connector 45.

The lens support 31 and the lamp support 41 are separate resin components and respectively formed by means of injection. Embodying the lens support and the lamp support separately from each other makes it easy to hold the lens 20, and assembly of the respective support sections is facilitated. The lens support 31 and the lamp support 41 can be integrally formed.

The above embodiment describes a structure in which the lens support 31 for supporting the characteristic lens 20 is attached to the general-purpose lamp support 41.

It may also be possible to omit the lens 20 and impart following characteristics of the lens 20 to a lens portion itself of the LED lamp 10. In this case, the lens support becomes a cylindrical member that solely supports the rod-shaped light-emitting element 3. In such an LED lamp, an LED chip serving as the LED light source is positioned on the centerline of the lens portion.

Figure 3:
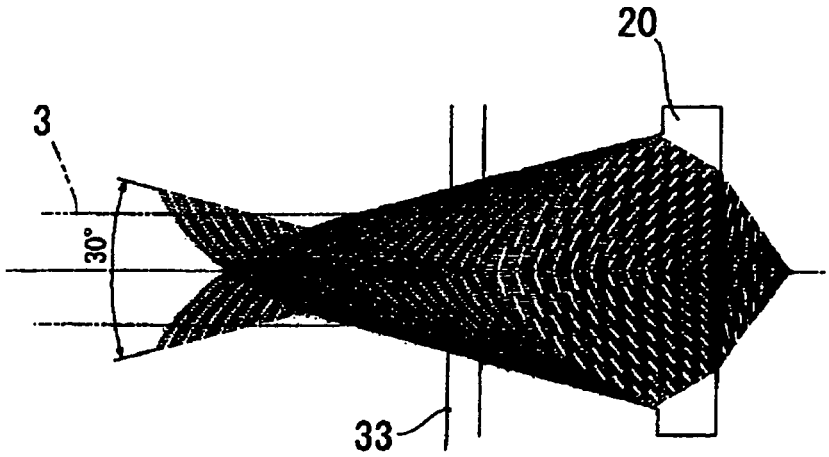
FIG. 3 is a view showing an optical characteristic of a lens 20 of an embodiment.

FIG. 3 shows an optical characteristic of the lens 20 of the present embodiment.

As is evident from FIG. 3, when light beams refracted along a plane of refraction of the lens 20 are compared with each other, a distance from the extremity of the lens at which light beams again cross the centerline after being refracted becomes greater with an increasing distance from the centerline within the refraction plane of the lens. Put another way, when underwent refraction on the refraction plane of the lens, light in proximity to the centerline crosses the centerline located immediately before the lens. Accordingly, light is radiated to the inner peripheral surface in the vicinity of the end face of the rod-shaped light-emitting element 3.

Figure 4:
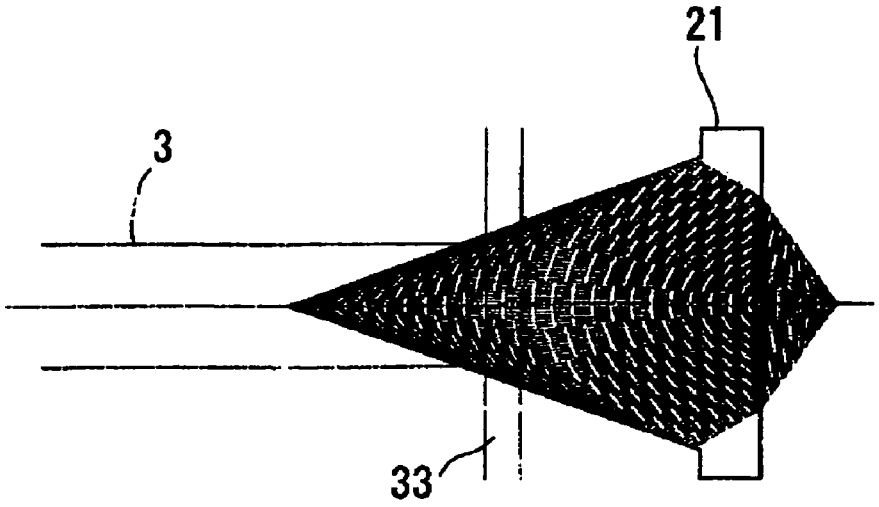
FIG. 4 is a view showing an optical characteristic of a related-art lens 21 of a focal point.

In the meantime, as shown in FIG. 4, light in proximity to the centerline travels substantially along the centerline in the lens 21 having an ordinary focal point. Hence, even after crossing the focal point, light travels substantially forward and is hardly radiated directly on the inner peripheral surface of the rod-shaped light-emitting element 3. Thus, light is guided to the other end face of the rod-shaped light-emitting element and hence does not contribute to the brightness of the circumferential wall.

Figure 5:
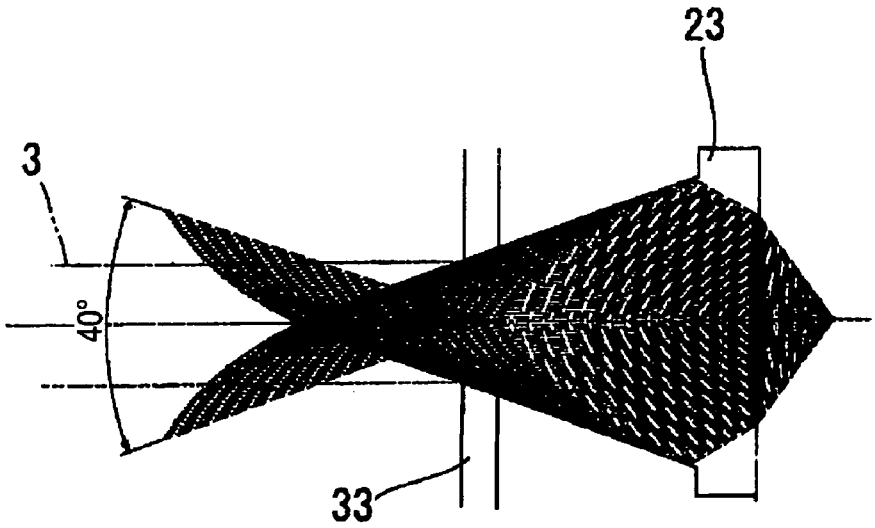
FIG. 5 is a view showing an optical characteristic of a lens 23 of another embodiment]

In the embodiment shown in FIG. 3, light refracted along the refraction plane of the lens is caused to travel substantially in parallel. An angle at which light refracted by one of the refraction planes separated along the centerline crosses light refracted by a remaining refraction plane is set to 30 degrees. FIG. 5 shows an example (a lens 23) in which the intersection angle is set to 40 degrees.

A curved surface of the lens shown in FIGS. 3 and 4 is defined as follows.

Figure 6:
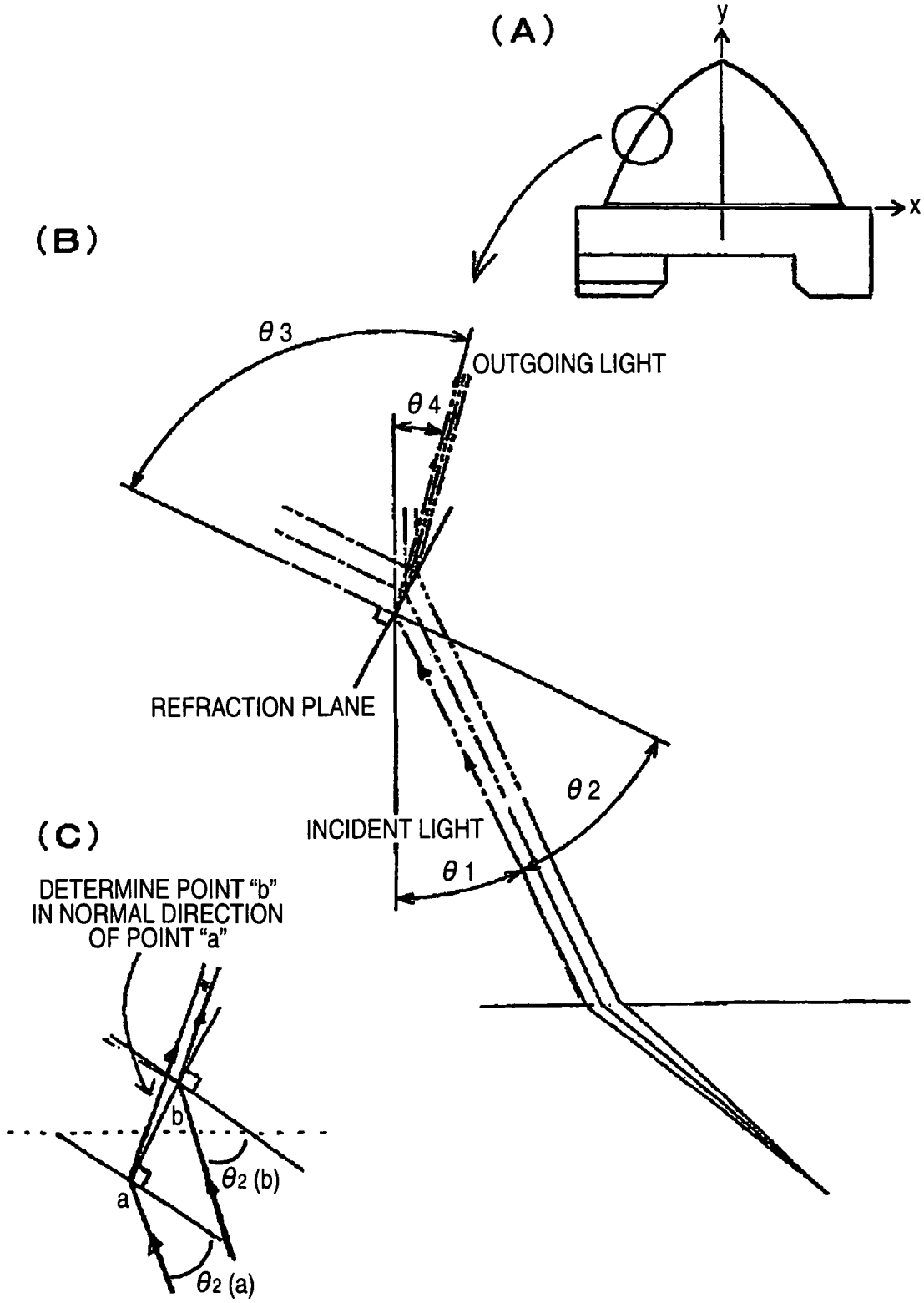
FIG. 6 is a view for describing a design philosophy of a refraction plane of a lens.

As shown in FIG. 6, coordinates of the lens are determined.

(1) The inclination $\theta 1+\theta 2$ of the refraction plane achieved at a certain point "a" (x, y) on the refraction plane of the lens is determined (see FIG. 6B).

$$\theta 1+\theta 2=\theta 3-\theta 4$$

$$n2*\sin\theta 2=n3*\sin\theta 3 \ldots \text{Snell's law}$$

θ1: an incident angle; that is, the inclination of incident light with reference to the centerline (0° to 90°)

θ4: an exit angle; that is, the inclination of outgoing light with reference to the centerline (an arbitrary constant)

θ2, θ3: an incident angle and an exit angle achieved along a boundary plane (Snell's law)

n2: a refractive index of a medium, n3: a refractive index of the outside (air).

(2) The inclination of a point "b" (x+Δx, y+Δy) separated from the point "a" (x, y) by an amount of Δx (Δy) in the direction of the refraction plane is determined (see FIG. 6C).

The geometry (points) of the lens is computed by repetition of operations (1) and (2). Points determined through computation are subjected to fitting, to thus determine the final geometry.

As a consequence, the geometry of the refraction plane of the lens 20 shown in FIG. 3 is approximated as follows:

$$y=-0.0072x^4+0.0212x^3-0.1637x^2-0.4086x+5.2822$$

The geometry of the refraction plane of the lens 23 shown in FIG. 5 is approximated as follows:

$$Y=-0.0068x^4+0.0185x^3-0.151x^2-0.5224x+5.6088$$

The entire refraction surfaces of the lenses 20 and 23 of the present embodiment are produced in accordance with the same design philosophy. However, the design philosophy may be applied solely to an area around the centerline of the lens (i.e., the extremity), and the other area of the lens may also be embodied as an ordinary lens refraction plane shown in FIG. 4. The reason for this is that all light beams, including light beams in close proximity to the centerline, can be radiated to a neighborhood of the end face of the rod-shaped light-emitting element.

Figure 7:
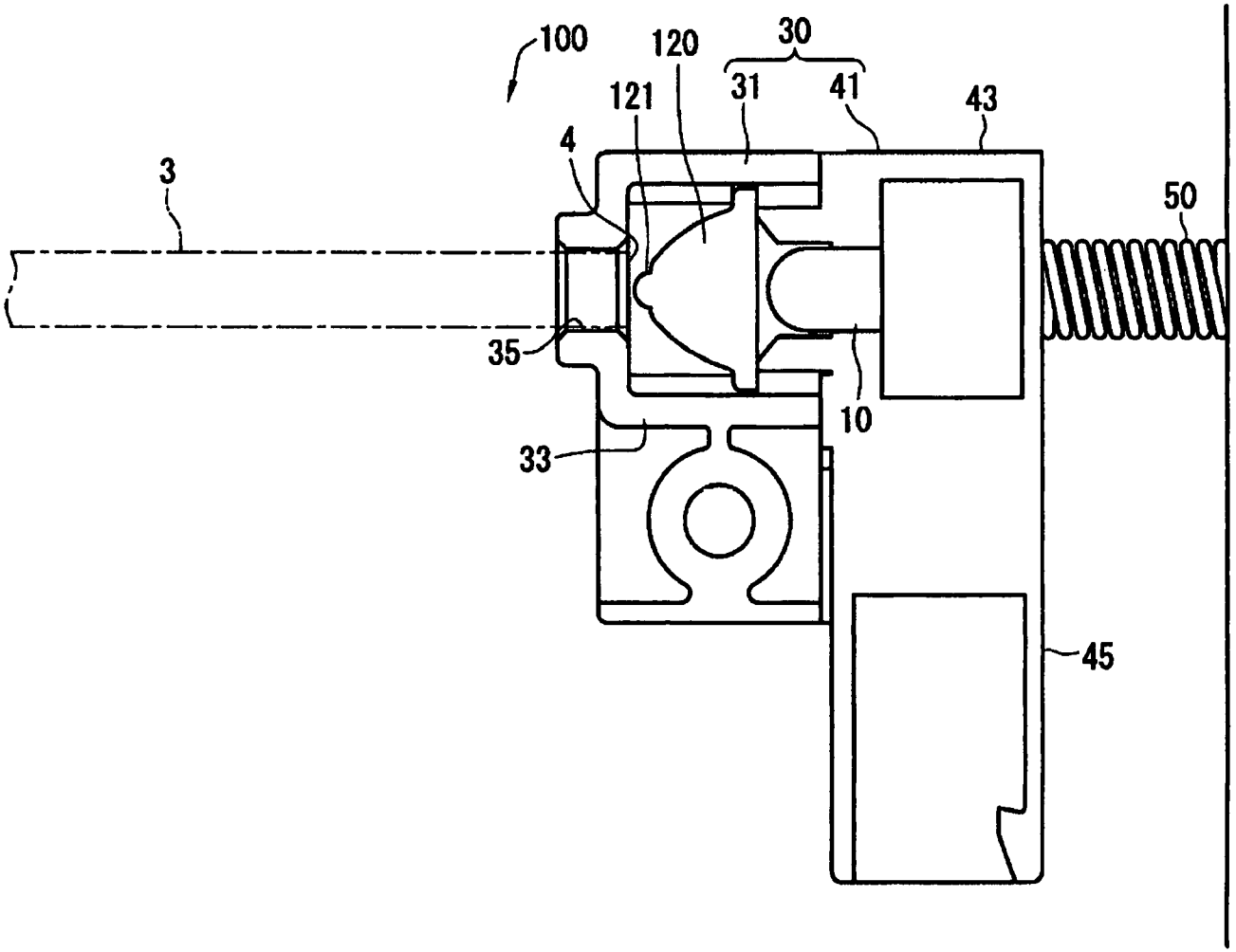
FIG. 7 is a view showing the configuration of a light-emitting device 100 of another embodiment.

FIG. 7 shows a light-emitting device 100 of another embodiment. In the drawing, elements that are the same as those shown in FIG. 1 are assigned the same reference numerals, and their explanations are omitted.

A lens 120 of the present embodiment has a hemispherical protrusion 121 at its extremity. Light in proximity to the centerline is scattered by the protrusion 121, thereby increasing an angle that the scattered light forms with the centerline. Thus, the light in proximity to the centerline is also reliably radiated onto the inner peripheral surface of the rod-shaped light-emitting element.

The present invention is not limited to the descriptions about the mode of implementation of the present invention and the embodiment of the present invention. The present invention encompasses various modifications without departing from descriptions provided in claims and within a range where those who are versed in the art can readily conceive the invention. All contents of a thesis, a Laid-Open Patent Publication, and a Patent Gazette, all of which are exemplified in the specification, are cited by reference.

What is claimed is:

1. A light-emitting device, comprising: a rod-shaped light-emitting element;

an LED light source; and a lens converging light from the LED light source to an end face of the rod-shaped light-emitting element; wherein the lens comprises a scattering area around a centerline of an extremity of the lens, and the scattering area scatters light in a proximity to the centerline to irradiate an inner peripheral surface of the rod-shaped light-emitting element with the light passed through an end face of the rod-shaped light-emitting element, and wherein the scattering area has a curved surface formed such that the light passed through a refraction plane of the scattering area is refracted toward the centerline, and such that the light passes through a point in the centerline that becomes further distant from the extremity of the lens with respect to a point on the refraction, plane by the light, becomes further distant from the centerline in a radial direction of the lens, with respect to a point on the refraction plane passed by the light becomes further distant from the centerline in a radial direction wherein a profile of the scattering area in a direction y perpendicular to a direction x of the centerline of an extremity of the lens is such that y changes with a fourth power of x.

2. The light-emitting device according to claim 1, wherein the scattering area occupies substantially an entirety of the lens.

3. The light-emitting device according to claim 1, wherein the scattering area comprises at least one of a convex and a concave area formed in the extremity of the lens in the centerline thereof.

4. The light-emitting device according to claim 3, wherein the convex area has a spherical shape.

5. The light-emitting device according to claim 1, wherein, after crossing a focal point of the lens, the light in the proximity to the centerline is irradiated toward the inner peripheral surface of the rod-shaped light-emitting element.

6. The light-emitting device according to claim 1, wherein a scattering agent is disposed on the rod-shaped light-emitting element such that light is uniformly emitted from a side surface of the rod-shaped light-emitting element.

7. The light-emitting device according to claim 1, wherein the rod-shaped light-emitting element comprises a two-layer structure comprising a core for guiding the light and a cladding for scattering and emitting the light.

8. The light-emitting device according to claim 1, wherein the centerline of the extremity of the lens coincides with a centerline of the rod-shaped light-emitting element and a centerline of the LED lamp.

9. The light-emitting device according to claim 1, further comprising:

a casing comprising a lens support and a lamp support; and a spring that impels the casing in an axial direction of the rod-shaped light-emitting element.

10. The light-emitting device according to claim 9, wherein the lens support is movable with respect to the lamp support along the axial direction of the rod-shaped light-emitting element.

11. The light-emitting device according to claim 9, wherein the lens support and the lamp support are formed integrally.

12. The light-emitting device according to claim 1, wherein said scattering area comprises a plurality of ones of the refraction plane, wherein light refracted along one of the plurality of ones of the refraction plane travels substantially in parallel.

13. The light-emitting device according to claim 1, wherein a profile of the scattering area in a direction y perpendicular to a direction x of the centerline of an extremity of the lens is expressed as one of $$y=-0.0072x^4+0.0212x^3-0.1637x^2 31\ 0.4085x+5.2822,$$

and $$y=-0.0058x^4+0.0185x^3-0.151x^2-0.5224x+5.6088.$$

14. The light-emitting device according to claim 1, wherein the lens comprises a hemispherical protrusion at the extremity of the lens.

15. A light-emitting device, comprising:

a rod-shaped light-emitting element;

an LED light source; and a lens for, converging light from the LED light source to an end face of the rod-shaped light-emitting element wherein the lens is formed such that the light passed through a refraction plane of the lens is refracted toward a centerline of an extremity of the lens and such that the light passes through a point in the centerline that becomes further distant from the extremity of the lens, with respect to a point on the refraction plane passed by the light becomes further distant from the centerline in a radial direction wherein a profile of the scattering area in a direction y perpendicular to a direction x of the centerline of an extremity of the lens is such that y changes with a fourth power of x.

16. The light-emitting device according to claim 15, wherein, after crossing a focal point of the lens, the light in a proximity to the centerline of the extremity of the lens is irradiated toward an inner surface of the rod-shaped light-emitting element.

17. A lens that is interposed between a rod-shaped light-emitting element and an LED light source and that converges light from the LED light source to an end face of the rod-shaped light-emitting element, wherein the lens is configured such that the light passed through a refraction plane of the lens is refracted toward a centerline of an extremity of the lens and that the light passes through a point in the centerline that becomes further distant from the extremity of the lens with respect to according a a point on the refraction plane passed by the light becomes further distant from the centerline in a radial direction wherein a profile of the scattering area in a direction y perpendicular to a direction x of the centerline of an extremity of the lens is such that y changes with a fourth power of x.

18. The lens according to claim 17, wherein, after crossing a focal point of the lens, the light in a proximity to the centerline of the extremity of the lens is irradiated toward an inner surface of the rod-shaped light-emitting element.

* * * * *